US009028626B2

(12) United States Patent
Nakagaito et al.

(10) Patent No.: US 9,028,626 B2
(45) Date of Patent: May 12, 2015

(54) METHOD FOR MANUFACTURING HIGH STRENGTH GALVANIZED STEEL SHEET WITH EXCELLENT FORMABILITY

(71) Applicant: JFE Steel Corporation, Tokyo (JP)

(72) Inventors: Tatsuya Nakagaito, Tokyo (JP); Saiji Matsuoka, Tokyo (JP); Shinjiro Kaneko, Tokyo (JP); Yoshiyasu Kawasaki, Tokyo (JP); Yoshitsugu Suzuki, Tokyo (JP)

(73) Assignee: JFE Steel Corporation (JP)

( * ) Notice: Subject to any disclaimer, the term of this patent is extended or adjusted under 35 U.S.C. 154(b) by 268 days.

(21) Appl. No.: 13/849,734

(22) Filed: Mar. 25, 2013

(65) Prior Publication Data

US 2014/0182748 A1 Jul. 3, 2014

Related U.S. Application Data

(62) Division of application No. 12/864,586, filed as application No. PCT/JP2009/051133 on Jan. 19, 2009, now Pat. No. 8,430,975.

(30) Foreign Application Priority Data

Jan. 31, 2008 (JP) ..... 2008-020201
Dec. 19, 2008 (JP) ..... 2008-323223

(51) Int. Cl.

| | |
|---|---|
| ***C21D 8/02*** | (2006.01) |
| ***C21D 1/25*** | (2006.01) |
| ***C21D 8/04*** | (2006.01) |
| ***C21D 9/48*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |

(52) U.S. Cl.

CPC ..... *C21D 8/0263* (2013.01); *Y10T 428/12799* (2015.01); *C21D 1/25* (2013.01); *C21D 8/0436* (2013.01); *C21D 8/0447* (2013.01); *C21D 9/48* (2013.01); *C21D 2211/001* (2013.01); *C21D 2211/005* (2013.01); *C21D 2211/008* (2013.01); *C22C 38/001* (2013.01); *C22C 38/02* (2013.01); *C22C 38/04* (2013.01); *C22C 38/06* (2013.01); *C23C 2/02* (2013.01)

(58) Field of Classification Search

None

See application file for complete search history.

(56) References Cited

U.S. PATENT DOCUMENTS

| | | | |
|---|---|---|---|
| 2003/0205457 | A1 | 11/2003 | Choi et al. |
| 2008/0283154 | A1 | 11/2008 | Taniguchi et al. |
| 2010/0104891 | A1 | 4/2010 | Nakagaito et al. |

FOREIGN PATENT DOCUMENTS

| | | | |
|---|---|---|---|
| EP | 1264911 | A2 | 12/2002 |
| JP | 6-093340 | A | 4/1994 |
| JP | 11-279691 | A | 10/1999 |
| JP | 2001-207235 | A | 7/2001 |
| JP | 2004-002409 | A | 1/2004 |
| JP | 2004-256872 | A | 9/2004 |
| JP | 2005-200690 | A | 7/2005 |
| JP | 2005-264328 | A | 9/2005 |
| JP | 2005-336526 | A | 12/2005 |
| JP | 2007-138262 | A | 6/2007 |
| JP | 2008-266778 | A | 11/2008 |
| JP | 2008-291304 | A | 12/2008 |

*Primary Examiner* — Deborah Yee

(74) *Attorney, Agent, or Firm* — DLA Piper LLP (US)

(57) ABSTRACT

A method of manufacturing a high-strength galvanized steel sheet includes hot-rolling a slab to form a steel sheet; during continuous annealing, heating the steel sheet to a temperature of 750° C. to 900° C. at an average heating rate of at least 10° C./s at a temperature of 500° C. to an $A_1$ transformation point; holding that temperature for at least 10 seconds; cooling the steel sheet from 750° C. to a temperature of (Ms point—100° C.) to (Ms point—200° C.) at an average cooling rate of at least 10° C./s; reheating the steel sheet to a temperature of 350° C. to 600° C.; holding that temperature for 10 to 600 seconds; and galvanizing the steel sheet.

6 Claims, No Drawings

METHOD FOR MANUFACTURING HIGH STRENGTH GALVANIZED STEEL SHEET WITH EXCELLENT FORMABILITY

TECHNICAL FIELD

This disclosure relates to a high-strength galvanized steel sheet with excellent formability that is suitable as a material used in industrial sectors such as automobiles and electronics, and a method for manufacturing the high-strength galvanized steel sheet.

BACKGROUND

In recent years, from the viewpoint of global environmental conservation, an improvement in fuel efficiency in automobiles has been an important issue. To address this issue, there is a strong movement under way to strengthen body materials to decrease the thickness of components, thereby decreasing the weight of bodies. However, an increase in strength of steel sheets causes a decrease in ductility, resulting in poor formability. Thus, under the existing circumstances, there is a demand for the development of high-strength materials with improved formability.

Furthermore, taking into account a recent growing demand for high corrosion resistance of automobiles, galvanized high-strength steel sheets have been developed frequently.

To satisfy these demands, various multiphase high-strength galvanized steel sheets, such as ferrite-martensite dual-phase steel (DP steel) and TRIP steel, which utilizes the transformation-induced plasticity of retained austenite, have been developed.

For example, JP 11-279691 proposes a high-strength galvannealed steel sheet with excellent formability that includes C: 0.05% to 0.15%, Si: 0.3% to 1.5%, Mn: 1.5% to 2.8%, P: 0.03% or less, S: 0.02% or less, Al: 0.005% to 0.5%, and N: 0.0060% or less, on the basis of mass percent, and Fe and incidental impurities as the remainder, wherein (Mn %)/(C %) is at least 15 and (Si %)/(C %) is at least 4. The galvannealed steel sheet contains 3% to 20% by volume of martensite phase and retained austenite phase in a ferrite phase. Thus, in a technique disclosed by JP 11-279691, a galvannealed steel sheet with excellent formability contains a large amount of Si to maintain residual γ, achieving high ductility.

However, although DP steel and TRIP steel have high ductility, they have poor stretch flangeability. The stretch flangeability is a measure of formability in expanding a machined hole to form a flange. The stretch flangeability, as well as ductility, is an important property for high-strength steel sheets.

JP 6-93340 discloses a method for manufacturing a galvanized steel sheet with excellent stretch flangeability, in which martensite produced by intensive cooling to an Ms point or lower between annealing/soaking and a hot-dip galvanizing bath is reheated to produce tempered martensite, thereby improving the stretch flangeability. However, although the stretch flangeability is improved by the transition from martensite to tempered martensite, EL is low.

As a high-tensile galvanized steel sheet with excellent deep drawability and stretch flangeability, JP 2004-2409 discloses a technique in which C, V, and Nb contents and annealing temperature are controlled to decrease the dissolved C content before recrystallization annealing, developing {111} recrystallization texture to achieve a high r-value, dissolving V and Nb carbides in annealing to concentrate C in austenite, thereby producing a martensite phase in a subsequent cooling process. However, this high-tensile galvanized steel sheet has a tensile strength of about 600 MPa and a balance between tensile strength and elongation (TS×EL) of about 19000 MPa·%. Thus, the strength and ductility are not sufficient.

As described above, the galvanized steel sheets described in JP 11-279691, JP 6-93340 and JP 2004-2409 are not high-strength galvanized steel sheets with excellent ductility and stretch flangeability.

In view of the situations described above, it could be helpful to provide a high-strength galvanized steel sheet that has a TS of at least 590 MPa and excellent ductility and stretch flangeability and a method for manufacturing the high-strength galvanized steel sheet.

SUMMARY

We conducted diligent research on the composition and the microstructure of a steel sheet to manufacture a high-strength galvanized steel sheet with excellent ductility and stretch flangeability. As a result, we found that if alloying elements are controlled appropriately, if, during cooling from the soaking temperature in an annealing process, intensive cooling to the temperature in the range of (Ms—100° C.) to (Ms—200° C.) (wherein Ms denotes the starting temperature of martensitic transformation from austenite (hereinafter also referred to as a Ms point or simply as MS) and is determined from the coefficient of linear expansion of steel) is performed for selective quenching to transform part of austenite into martensite, and if reheating is performed for plating after the selective quenching, then a ferrite phase can be 20% or more, a martensite phase can be 10% or less (including 0%), and a tempered martensite can be in the range of 10% to 60%, on the basis of area percent, and a retained austenite phase can be in the range of 3% to 10% by volume, and the retained austenite can have an average grain size of 2.0 μm or less, and such a microstructure can provide high ductility and stretch flangeability.

In general, the presence of retained austenite improves ductility owing to the TRIP effect of the retained austenite. However, it is also known that strain causes retained austenite to be transformed into very hard martensite. This increases the difference in hardness between the martensite and the main ferrite phase, thereby reducing stretch flangeability.

In contrast, our steels have components and a microstructure that achieves high ductility and stretch flangeability. Thus, high stretch flangeability can be achieved even in the presence of retained austenite. Although the reason for this high stretch flangeability even in the presence of retained austenite is not clear in detail, the reason may be a decrease in size of retained austenite and the formation of a complex phase between retained austenite and tempered martensite.

In addition to these findings, we also found that stable retained austenite containing at least 1% of dissolved C on average can improve deep drawability as well as ductility.

We thus provide:

[1] A high-strength galvanized steel sheet with excellent formability, containing, on the basis of mass percent, C: 0.05% to 0.3%, Si: 0.01% to 2.5%, Mn: 0.5% to 3.5%, P: 0.003% to 0.100% or less, S: 0.02% or less, and Al: 0.010% to 1.5%, the total of Si and Al being 0.5% to 2.5%, the remainder being iron and incidental impurities, wherein the high-strength galvanized steel sheet has a microstructure that includes 20% or more of ferrite phase, 10% or less of martensite phase, and 10% to 60% of tempered martensite phase, on the basis of area percent, and 3% to 10% of retained austenite phase on the basis of volume percent, and the retained austenite phase has an average grain size of 2.0 μm or less.

[2] The high-strength galvanized steel sheet with excellent formability according to [1], wherein the retained austenite phase contains at least 1% of dissolved C on average.

[3] The high-strength galvanized steel sheet with excellent formability according to [1] or [2], further containing one or at least two elements selected from the group consisting of Cr: 0.005% to 2.00%, Mo: 0.005% to 2.00%, V: 0.005% to 2.00%, Ni: 0.005% to 2.00%, and Cu: 0.005% to 2.00%, on the basis of mass percent.

[4] The high-strength galvanized steel sheet with excellent formability according to any one of [1] to [3], further containing one or two elements selected from the group consisting of Ti: 0.01% to 0.20% and Nb: 0.01% to 0.20%, on the basis of mass percent.

[5] The high-strength galvanized steel sheet with excellent formability according to any one of [1] to [4], further containing B: 0.0002% to 0.005% by mass.

[6] The high-strength galvanized steel sheet with excellent formability according to any one of [1] to [5], further containing one or two elements selected from the group consisting of Ca: 0.001% to 0.005% and REM: 0.001% to 0.005%, on the basis of mass percent.

[7] The high-strength galvanized steel sheet with excellent formability according to any one of [1] to [6], wherein galvanization is galvannealing.

[8] A method for manufacturing a high-strength galvanized steel sheet with excellent formability, including the steps of: hot-rolling a slab that contains components according to any one of [1] to [6] to form a steel sheet; in continuous annealing, heating the hot-rolled steel sheet to a temperature in the range of 750° C. to 900° C. at an average heating rate of at least 10° C./s in the temperature range of 500° C. to an $A_1$ transformation point, holding that temperature for at least 10 seconds, cooling the steel sheet from 750° C. to a temperature in the range of (Ms point—100° C.) to (Ms point—200° C.) at an average cooling rate of at least 10° C./s, reheating the steel sheet to a temperature in the range of 350° C. to 600° C., and holding that temperature for 10 to 600 seconds; and galvanizing the steel sheet.

[9] A method for manufacturing a high-strength galvanized steel sheet with excellent formability, including the steps of: hot-rolling and cold-rolling a slab that contains components according to any one of [1] to [6] to form a steel sheet; in continuous annealing, heating the cold-rolled steel sheet to a temperature in the range of 750° C. to 900° C. at an average heating rate of at least 10° C./s in the temperature range of 500° C. to an $A_1$ transformation point, holding that temperature for at least 10 seconds, cooling the steel sheet from 750° C. to a temperature in the range of (Ms point—100° C.) to (Ms point—200° C.) at an average cooling rate of at least 10° C./s, reheating the steel sheet to a temperature in the range of 350° C. to 600° C., and holding that temperature for 10 to 600 seconds; and galvanizing the steel sheet.

[10] The method for manufacturing a high-strength galvanized steel sheet with excellent formability according to [8] or [9], wherein the holding time after reheating to 350° C. to 600° C. ranges from t to 600 seconds as determined by the following formula (1):

$$t(s)=2.5\times10^{-5}/\mathrm{Exp}(-80400/8.31/(T+273)) \quad (1)$$

wherein T denotes the reheating temperature (° C.).

[11] The method for manufacturing a high-strength galvanized steel sheet with excellent formability according to any one of [8] to [10], wherein the galvanizing is followed by alloying.

DETAILED DESCRIPTION

In this specification, all the percentages of components of steel are based on mass percent. The term "high-strength galvanized steel sheet," as used herein, refers to a galvanized steel sheet having a tensile strength TS of at least 590 MPa.

We provide a high-strength galvanized steel sheet that has a TS of at least 590 MPa and excellent ductility, stretch flangeability, and deep drawability. Use of a high-strength galvanized steel sheet, for example, in automobile structural members, allows both weight reduction and an improvement in crash safety of the automobiles, thus having excellent effects of contributing to high performance of automobile bodies.

The steels will be described in detail below.

1) Composition

C: 0.05% to 0.3%

C stabilizes austenite and facilitates the formation of layers other than ferrite. Thus, C is necessary to strengthen a steel sheet and combine phases to improve the balance between TS and EL. At a C content below 0.05%, even when the manufacturing conditions are optimized, it is difficult to form phases other than ferrite and, therefore, the balance between TS and EL deteriorates. At a C content above 0.3%, weld and heat-affected zones are hardened considerably and, therefore, mechanical characteristics of the weld deteriorate. Thus, the C content ranges from 0.05% to 0.3%. Preferably, the C content ranges from 0.08% to 0.15%.

Si: 0.01% to 2.5%

Si is effective to strengthen steel. Si is a ferrite-generating element, promotes the concentration of C in an austenite phase, and reduces the production of carbide, thus promoting the formation of retained austenite. To produce such effects, the Si content must be at least 0.01%. However, an excessive amount of Si reduces ductility, surface quality, and weldability. Thus, the maximum Si content is 2.5% or less. Preferably, the Si content ranges from 0.7% to 2.0%.

Mn: 0.5% to 3.5%

Mn is effective to strengthen steel and promotes formation of low-temperature transformation phases such as a tempered martensite phase. Such effects can be observed at a Mn content of 0.5% or more. However, an excessive amount of Mn above 3.5% results in an excessive increase in a second phase fraction or considerable degradation in ductility of ferrite due to solid solution strengthening, thus reducing formability. Thus, the Mn content ranges from 0.5% to 3.5%. Preferably, the Mn content ranges from 1.5% to 3.0%.

P: 0.003% to 0.100%

P is effective to strengthen steel at a P content of 0.003% or more. However, an excessive amount of P above 0.100% causes embrittlement owing to grain boundary segregation, thus reducing impact resistance. Thus, the P content ranges from 0.003% to 0.100%.

S: 0.02% or less

S acts as an inclusion, such as MnS, and may cause deterioration in anti-crash property and a crack along the metal flow of a weld. Thus, the S content should be minimized. In view of manufacturing costs, the S content is 0.02% or less.

Al: 0.010% to 1.5%, Si+Al: 0.5% to 2.5%

Al acts as a deoxidizer and is effective for cleanliness of steel. Preferably, Al is added in a deoxidation process. To produce such an effect, the Al content must be at least 0.010%. However, an excessive amount of Al increases the risk of causing a fracture in a slab during continuous casting, thus reducing productivity. Thus, the maximum Al content is 1.5%.

Like Si, Al is a ferrite phase-generating element, promotes the concentration of C in an austenite phase, and reduces the production of carbide, thus promoting the formation of a retained austenite phase. At a total content of Al and Si below 0.5%, such effects are insufficient and, therefore, ductility is insufficient. However, more than 2.5% of Al and Si in total increases inclusions in a steel sheet, thus reducing ductility. Thus, the total content of Al and Si is 2.5% or less.

0.01% or less of N is acceptable because working effects such as formability are not reduced.

The remainder are Fe and incidental impurities.

In addition to these component elements, our high-strength galvanized steel sheet can contain the following alloying elements if necessary.

One or at least two elements selected from the group consisting of Cr: 0.005% to 2.00%, Mo: 0.005% to 2.00%, V: 0.005% to 2.00%, Ni: 0.005% to 2.00%, and Cu: 0.005% to 2.00%

Cr, Mo, V, Ni, and Cu reduce the formation of a pearlite phase in cooling from the annealing temperature and promote formation of a low-temperature transformation phase, thus effectively strengthening steel. This effect is achieved when a steel sheet contains 0.005% or more of at least one element selected from the group consisting of Cr, Mo, V, Ni, and Cu. However, more than 2.00% of each of Cr, Mo, V, Ni, and Cu has a saturated effect and is responsible for an increase in cost. Thus, the content of each of Cr, Mo, V, Ni, and Cu ranges from 0.005% to 2.00% if they are present.

One or two elements selected from Ti: 0.01% to 0.20% and Nb: 0.01% to 0.20%

Ti and Nb form a carbonitride and have the effect of strengthening steel by precipitation hardening. Such an effect is observed at a Ti or Nb content of 0.01% or more. However, more than 0.20% of Ti or Nb excessively strengthens steel and reduces ductility. Thus, the Ti or Nb content ranges from 0.01% to 0.20% if they are present.

B: 0.0002% to 0.005%

B reduces formation of ferrite from austenite phase boundaries and increases the strength. These effects are achieved at a B content of 0.0002% or more. However, more than 0.005% of B has saturated effects and is responsible for an increase in cost. Thus, the B content ranges from 0.0002% to 0.005% if B is present.

One or two elements selected from Ca: 0.001% to 0.005% and REM: 0.001% to 0.005%

Ca and REM have an effect of improving formability by the morphology control of sulfides. If necessary, a high-strength galvanized steel sheet can contain 0.001% or more of one or two elements selected from Ca and REM. However, an excessive amount of Ca or REM may have adverse effects on cleanliness. Thus, the Ca or REM content is 0.005% or less.

2) Microstructure

The area fraction of ferrite phase is 20% or more.

Less than 20% by area of ferrite phase upsets the balance between TS and EL. Thus, the area fraction of ferrite phase is 20% or more. Preferably, the area fraction of ferrite phase is 50% or more.

The area fraction of martensite phase ranges from 0% to 10%

A martensite phase effectively strengthens steel. However, an excessive amount of martensite phase above 10% by area significantly reduces λ (hole expansion ratio). Thus, the area fraction of martensite phase is 10% or less. The absence of martensite phase, that is, 0% by area of martensite phase has no influence on the advantages of our steels and causes no problem. The area fraction of tempered martensite phase ranges from 10% to 60%

A tempered martensite phase effectively strengthens steel. A tempered martensite phase has less adverse effects on stretch flangeability than a martensite phase. Thus, the tempered martensite phase can effectively strengthen steel without significantly reducing stretch flangeability. Less than 10% of tempered martensite phase is difficult to strengthen steel. More than 60% of tempered martensite phase upsets the balance between TS and EL. Thus, the area percentage of tempered martensite phase ranges from 10% to 60%.

The volume fraction of retained austenite phase ranges from 3% to 10%; the average grain size of retained austenite phase is 2.0 μm or less; and, suitably, the average concentration of dissolved C in retained austenite phase is 1% or more. A retained austenite phase not only contributes to strengthening of steel, but also effectively improves the balance between TS and EL of steel. These effects are achieved when the volume fraction of retained austenite phase is 3% or more. Although processing transforms a retained austenite phase into martensite, thereby reducing stretch flangeability, a significant reduction in stretch flangeability can be avoided when the retained austenite phase has an average grain size of 2.0 μm or less and is 10% or less by volume. Thus, the volume fraction of retained austenite phase ranges from 3% to 10%, and the average grain size of retained austenite phase is 2.0 μm or less.

An increase in average concentration of dissolved C in a retained austenite phase improves deep drawability. This effect is noticeable when the average concentration of dissolved C in the retained austenite phase is 1% or more.

While phases other than a ferrite phase, a martensite phase, a tempered martensite phase, and a retained austenite phase include a pearlite phase and a bainite phase, our steel sheets can be achieved if the microstructure described above is attained. The pearlite phase is desirably 3% or less to secure ductility and stretch flangeability.

The area fractions of ferrite phase, martensite phase, and tempered martensite phase, as used herein, refer to the fractions of their respective areas in an observed area. The area fraction can be determined by polishing a cross section of a steel sheet in the thickness direction parallel to the rolling direction, causing corrosion of the cross section with 3% nital, observing 10 visual fields with a scanning electron microscope (SEM) at a magnification of 2000, and analyzing the observation with commercially available image processing software. The volume fraction of retained austenite phase is the ratio of the integrated X-ray diffraction intensity of (200), (220), and (311) planes in fcc iron to the integrated X-ray diffraction intensity of (200), (211), and (220) planes in bcc iron at a quarter thickness.

The average grain size of a retained austenite phase is a mean value of crystal sizes of 10 grains. The crystal size is determined by observing a thin film with a transmission electron microscope (TEM), determining an arbitrarily selected area of austenite by image analysis, and, on the assumption that an austenite grain is a square, calculating the length of one side of the square as the diameter of the grain.

The average concentration of dissolved C ([Cγ%]) in a retained austenite phase can be calculated by substituting the lattice constant a (angstrom), which is determined from a diffraction plane (220) of fcc iron with an X-ray diffractometer using Co-Kα, [Mn %], and [Al %] into the following formula (2):

$$a=3.578+0.033[C\gamma\%]+0.00095[Mn\ \%]+0.0056[Al\ \%] \quad (2)$$

wherein [Cγ%] denotes the average concentration of dissolved C in the retained austenite phase, and [Mn %] and [Al %] denote the Mn content and the Al content (% by mass), respectively.

3) Manufacturing Condition

A high-strength galvanized steel sheet can be manufactured by hot rolling a slab that contains components described above directly followed by continuous annealing or followed by cold rolling and subsequent continuous annealing, wherein the steel sheet is heated to a temperature in the range of 750° C. to 900° C. at an average heating rate of at least 10° C./s in the temperature range of 500° C. to an $A_1$ transformation point, held at that temperature for at least 10 seconds, is cooled from 750° C. to a temperature in the range of (Ms point—100° C.) to (Ms point—200° C.) at an average cooling rate of at least 10° C./s, reheated to a temperature in the range of 350° C. to 600° C., held at that temperature for 10 to 600 seconds, and galvanized. Preferably, the holding time after the steel sheet is heated to a temperature in the range of 350° C. to 600° C. ranges from t to 600 seconds as determined by the following formula (1):

$$t(s)=2.5\times10^{-5}/\mathrm{Exp}(-80400/8.31/(T+273)) \quad (1)$$

wherein T denotes the reheating temperature (° C.).

The following is a detailed description.

Steel having the composition as described above is melted, for example, in a converter and formed into a slab, for example, by continuous casting. Preferably, a steel slab is manufactured by continuous casting to prevent macrosegregation of the components. The steel slab may be manufactured by an ingot-making process or thin slab casting. After manufacture of a steel slab, in accordance with a conventional method, the slab may be cooled to room temperature and reheated. Alternatively, without cooling to room temperature, the slab may be subjected to an energy-saving process such as hot direct rolling or direct rolling in which a hot slab is conveyed directly into a furnace or is immediately rolled after short warming.

Slab heating temperature: at least 1100° C. (suitable conditions)

The slab heating temperature is preferably low to save energy. However, at a heating temperature below 1100° C., carbide may not be dissolved sufficiently, or the occurrence of trouble may increase in hot rolling because of an increase in rolling load. In view of an increase in scale loss associated with an increase in weight of oxides, the slab heating temperature is desirably 1300° C. or less. A sheet bar may be heated using a so-called "sheet bar heater" to prevent trouble in hot rolling even at a low slab heating temperature.

Final finish rolling temperature: at least $A_3$ point (suitable conditions)

At a final finish rolling temperature below $A_3$ point, α and γ may be formed in rolling, and a steel sheet is likely to have a banded microstructure. The banded structure may remain after cold rolling or annealing, causing anisotropy in material properties or reducing formability. Thus, the finish rolling temperature is desirably at least $A_3$ transformation point.

Winding temperature: 450° C. to 700° C. (suitable conditions)

At a coiling temperature below 450° C., the coiling temperature is difficult to control. This tends to cause unevenness in temperature, thus causing problems such as low cold rollability. At a coiling temperature above 700° C., decarbonization may occur at the ferrite surface layer. Thus, the coiling temperature desirably ranges from 450° C. to 700° C.

In a hot rolling process, finish rolling may be partly or entirely lubrication rolling to reduce rolling load. Lubrication rolling is also effective to uniformize the shape of a steel sheet and the quality of material. The coefficient of friction in lubrication rolling preferably ranges from 0.25 to 0.10. Preferably, adjacent sheet bars are joined to each other to perform a continuous rolling process in which the adjacent sheet bars are continuously finish-rolled. The continuous rolling process is desirable also in terms of stable hot rolling.

A hot-rolled sheet is then subjected to continuous annealing directly or after cold rolling. In cold rolling, preferably, after oxide scale on the surface of a hot-rolled steel sheet is removed by pickling, the hot-rolled steel sheet is cold-rolled to produce a cold-rolled steel sheet having a predetermined thickness. The pickling conditions and the cold rolling conditions are not limited to particular conditions and may be common conditions. The draft in cold rolling is preferably at least 40%.

Continuous annealing conditions: heating to a temperature in the range of 750° C. to 900° C. at an average heating rate of at least 10° C./s in the temperature range of 500° C. to an $A_1$ transformation point The average heating rate of at least 10° C./s in the temperature range of 500° C. to the $A_1$ transformation point, which is a recrystallization temperature range in steel, results in prevention of recrystallization in heating, thus decreasing the size of γ formed at the $A_1$ transformation point or higher temperatures, which in turn effectively decreases the size of a retained austenite phase after annealing and cooling. At an average heating rate below 10° C./s, recrystallization of α proceeds in heating, relieving strain accumulated in α. Thus, the size of γ cannot be decreased sufficiently. A preferred average heating rate is 20° C./s or more.

Holding at a temperature in the range of 750° C. to 900° C. for at least 10 seconds At a holding temperature below 750° C. or a holding time below 10 seconds, an austenite phase is not formed sufficiently in annealing. Thus, after annealing and cooling, a low-temperature transformation phase cannot be formed sufficiently. A heating temperature above 900° C. results in coarsening of an austenite phase formed in heating and also coarsening of a retained austenite phase after annealing. The maximum holding time is not limited to a particular time. However, holding for 600 seconds or more has saturating effects and only increases costs. Thus, the holding time is preferably less than 600 seconds.

Cooling from 750° C. to a temperature in the range of (Ms point—100° C.) to (Ms point—200° C.) at an average cooling rate of at least 10° C./s An average cooling rate below 10° C./s results in formation of pearlite, thus reducing the balance between TS and EL and stretch flangeability. The maximum average cooling rate is not limited to a particular rate. However, at an excessively high average cooling rate, a steel sheet may have an undesirable shape, or the ultimate cooling temperature is difficult to control. Thus, the cooling rate is preferably 200° C./s or less.

The ultimate cooling temperature condition is one of the most important conditions. When cooling is stopped, part of an austenite phase is transformed into martensite, and the remainder is untransformed austenite phase. After subsequent reheating, plating and alloying, cooling to room temperature transforms the martensite phase into a tempered martensite phase, and the untransformed austenite phase into a retained austenite phase or a martensite phase. A lower ultimate cooling temperature after annealing and a larger degree of supercooling from the Ms point (Ms point: starting temperature of martensitic transformation of austenite) result in an increase in the amount of martensite formed during cooling and a decrease in the amount of untransformed austenite. Thus, the final area fractions of the martensite phase, the retained austenite phase, and the tempered martensite phase depend on the control of the ultimate cooling temperature. Therefore, the degree of supercooling, which is the difference between the Ms point and the finish cooling temperature, is important. Thus, the Ms point is used herein as a measure of the cooling temperature control. At an ultimate cooling temperature higher than (Ms point—100° C.), the martensitic transformation is insufficient when cooling is stopped. This results in an increase in the amount of untransformed austenite, excessive formation of a martensite phase or a retained austenite phase in the end, and poor stretch flangeability. At an ultimate cooling temperature lower than (Ms—200° C.), most of the austenite phase is transformed into martensite. Thus, the amount of untransformed austenite decreases, and 3% or more of retained austenite phase cannot be formed. Thus, the ultimate cooling temperature ranges from (Ms point—100° C.) to (Ms point—200° C.).

The Ms point can be determined from a change in the coefficient of linear expansion, which is determined by measuring the volume change of a steel sheet in cooling after annealing.

Reheating to a temperature in the range of 350° C. to 600° C., holding that temperature for 10 to 600 seconds (suitably, a range of t to 600 seconds as determined by the following formula (1)), and galvanizing:

$$t(s)=2.5\times10^{-5}/\mathrm{Exp}(-80400/8.31/(T+273)) \quad (1)$$

wherein T denotes the reheating temperature (° C.).

After cooling to a temperature in the range of (Ms point—100° C.) to (Ms point—200° C.), reheating to a temperature in the range of 350° C. to 600° C. and holding that temperature for 10 to 600 seconds can temper the martensite phase formed in the cooling into a tempered martensite phase, thus improving stretch flangeability. Furthermore, the untransformed austenite phase that is not transformed into martensite in the cooling is stabilized. Three percent or more of retained austenite phase is finally formed, thus improving ductility. While the mechanism of stabilizing an untransformed austenite phase by heating and holding is not clear in detail, the concentration of C in untransformed austenite may be promoted and thereby stabilize the austenite phase. A heating temperature below 350° C. results in insufficient tempering of the martensite phase and insufficient stabilization of the austenite phase, thus reducing stretch flangeability and ductility. At a heating temperature above 600° C., the untransformed austenite phase after cooling is transformed into pearlite. Thus, 3% or more of retained austenite phase cannot be formed in the end. Thus, the reheating temperature ranges from 350° C. to 600° C. At a holding time below 10 seconds, the austenite phase is not stabilized sufficiently. At a holding time above 600 seconds, the untransformed austenite phase after cooling is transformed into bainite. Thus, 3% or more of retained austenite phase cannot be formed in the end. Thus, the heating temperature ranges from 350° C. to 600° C., and the holding time in that temperature range ranges from 10 to 600 seconds. Furthermore, when the holding time is at least t seconds as determined by the above-mentioned formula (1), retained austenite containing at least 1% of dissolved C on average can be formed. Thus, the holding time preferably ranges from t to 600 seconds.

In plating, a steel sheet is immersed in a plating bath (bath temperature: 440° C. to 500° C.) that contains 0.12% to 0.22% and 0.08% to 0.18% of dissolved Al in manufacture of a galvanized steel sheet (GI) and a galvannealed steel sheet (GA), respectively. The amount of deposit is adjusted, for example, by gas wiping. After adjusting the amount of deposit, a galvannealed steel sheet is treated by heating the sheet to a temperature in the range of 450° C. to 600° C. and holding that temperature for 1 to 30 seconds.

A galvanized steel sheet (including a galvannealed steel sheet) may be subjected to temper rolling to correct the shape or adjust the surface roughness, for example. A galvanized steel sheet may also be treated by resin or oil coating and various coatings without any trouble.

EXAMPLES

Steel that contains the components shown in Table 1 and the remainder of Fe and incidental impurities was melted in a converter and was formed into a slab by continuous casting. The slab was hot-rolled to a thickness of 3.0 mm. Conditions for hot rolling included a finishing temperature of 900° C., a cooling rate of 10° C./s after rolling, and a winding temperature of 600° C. The hot-rolled steel sheet was then washed with an acid and was cold-rolled to a thickness of 1.2 mm to produce a cold-rolled steel sheet. A steel sheet that was hot-rolled to a thickness of 2.3 mm was also washed with an acid and was used for annealing. The cold-rolled steel sheet or the hot-rolled sheet thus produced was then annealed in a continuous galvanizing line under the conditions shown in Table 2, was galvanized at 460° C., was subjected to alloying at 520° C., and was cooled at an average cooling rate of 10° C./s. In part of the steel sheets, galvanized steel sheets were not subjected to alloying. The amount of deposit ranged from 35 to 45 g/m$^2$ per side.

TABLE 1

(% by mass)

| Type of steel | C | Si | Mn | P | S | Al | N | Cr | Mo | V | Ni | Cu | Ti | Nb | B | Ca | REM | |
|---|---|---|---|---|---|---|---|---|---|---|---|---|---|---|---|---|---|---|
| A | 0.08 | 1.2 | 2.0 | 0.020 | 0.003 | 0.033 | 0.003 | — | — | — | — | — | — | — | — | — | — | Example |
| B | 0.14 | 1.5 | 1.8 | 0.015 | 0.002 | 0.037 | 0.002 | — | — | — | — | — | — | — | — | — | — | Example |
| C | 0.17 | 1.0 | 1.4 | 0.017 | 0.004 | 1.0 | 0.005 | — | — | — | — | — | — | — | — | — | — | Example |
| D | 0.25 | 0.02 | 1.8 | 0.019 | 0.002 | 1.5 | 0.004 | — | — | — | — | — | — | — | — | — | — | Example |
| E | 0.11 | 1.3 | 2.1 | 0.025 | 0.003 | 0.036 | 0.004 | 0.50 | — | — | — | — | — | — | — | — | — | Example |
| F | 0.20 | 1.0 | 1.6 | 0.013 | 0.005 | 0.028 | 0.005 | — | 0.4 | — | — | — | — | — | — | — | — | Example |
| G | 0.13 | 1.3 | 1.2 | 0.008 | 0.006 | 0.031 | 0.003 | — | — | 0.05 | — | — | — | — | — | — | — | Example |
| H | 0.16 | 0.6 | 2.7 | 0.014 | 0.002 | 0.033 | 0.004 | — | — | — | 0.4 | — | — | — | — | — | — | Example |
| I | 0.08 | 1.0 | 2.2 | 0.007 | 0.003 | 0.025 | 0.002 | — | — | — | 0.2 | 0.4 | — | — | — | — | — | Example |
| J | 0.12 | 1.1 | 1.9 | 0.007 | 0.002 | 0.033 | 0.001 | — | — | — | — | — | 0.04 | — | — | — | — | Example |
| K | 0.10 | 1.5 | 2.7 | 0.014 | 0.001 | 0.042 | 0.003 | — | — | — | — | — | — | 0.05 | — | — | — | Example |
| L | 0.10 | 0.6 | 1.9 | 0.021 | 0.005 | 0.015 | 0.004 | — | — | — | — | — | 0.02 | — | 0.001 | — | — | Example |

TABLE 1-continued (% by mass)

| Type of steel | C | Si | Mn | P | S | Al | N | Cr | Mo | V | Ni | Cu | Ti | Nb | B | Ca | REM | |
|---|---|---|---|---|---|---|---|---|---|---|---|---|---|---|---|---|---|---|
| M | 0.16 | 1.2 | 2.9 | 0.006 | 0.004 | 0.026 | 0.002 | — | — | — | — | — | — | — | — | 0.003 | — | Example |
| N | 0.09 | 2.0 | 2.1 | 0.012 | 0.003 | 0.028 | 0.005 | — | — | — | — | — | — | — | — | — | 0.002 | Example |
| O | 0.04 | 1.4 | 1.7 | 0.013 | 0.002 | 0.022 | 0.002 | — | — | — | — | — | — | — | — | — | — | Comparative Example |
| P | 0.15 | 0.5 | 4.0 | 0.022 | 0.001 | 0.036 | 0.002 | — | — | — | — | — | — | — | — | — | — | Comparative Example |
| Q | 0.09 | 1.2 | 0.3 | 0.007 | 0.003 | 0.029 | 0.002 | — | — | — | — | — | — | — | — | — | — | Comparative Example |

TABLE 2

| No. | Type of steel | A1 transformation point (° C.) | Presence of cold rolling | Average heating rate to 500° C. to A1 transformation point | Maximum temperature (° C.) | Holding time (s) | Cooling rate (° C./s) | Temperature achieved after cooling (° C.) | Ms point (° C.) | Reheating Temperature (° C.) | Holding time after reheating (s) | t*) (s) | Presence of plating and alloying | |
|---|---|---|---|---|---|---|---|---|---|---|---|---|---|---|
| 1 | A | 725 | Yes | 25 | 830 | 60 | 50 | 200 | 357 | 400 | 80 | 44 | Yes | Example |
| 2 | A | 725 | Yes | 5 | 830 | 60 | 50 | 200 | 377 | 400 | 80 | 44 | Yes | Comparative Example |
| 3 | A | 725 | Yes | 25 | 810 | 60 | 50 | 100 | 353 | 420 | 80 | 29 | Yes | Comparative Example |
| 4 | B | 732 | Yes | 30 | 850 | 90 | 80 | 180 | 366 | 430 | 60 | 24 | Yes | Example |
| 5 | B | 732 | Yes | 30 | 720 | 60 | 80 | 250 | 398 | 430 | 60 | 24 | Yes | Comparative Example |
| 6 | B | 732 | Yes | 30 | 950 | 60 | 80 | 220 | 384 | 400 | 60 | 44 | Yes | Comparative Example |
| 7 | C | 727 | Yes | 15 | 820 | 90 | 30 | 160 | 321 | 450 | 45 | 16 | No | Example |
| 8 | C | 727 | Yes | 20 | 820 | 5 | 30 | 120 | 270 | 450 | 45 | 16 | No | Comparative Example |
| 9 | C | 727 | Yes | 20 | 820 | 90 | 30 | 30 | 321 | 450 | 45 | 16 | No | Comparative Example |
| 10 | D | 704 | Yes | 20 | 780 | 150 | 70 | 150 | 324 | 450 | 60 | 16 | Yes | Example |
| 11 | D | 704 | Yes | 20 | 780 | 120 | 3 | 210 | 360 | 450 | 60 | 16 | Yes | Comparative Example |
| 12 | D | 704 | Yes | 20 | 780 | 120 | 100 | 280 | 361 | 450 | 50 | 16 | Yes | Comparative Example |
| 13 | E | 734 | Yes | 25 | 850 | 75 | 80 | 180 | 349 | 400 | 30 | 44 | Yes | Example |
| 14 | E | 734 | Yes | 25 | 850 | 60 | 80 | 200 | 342 | 250 | 60 | 2704 | Yes | Comparative Example |
| 15 | E | 734 | Yes | 25 | 830 | 75 | 80 | 200 | 339 | 650 | 60 | 1 | Yes | Comparative Example |
| 16 | E | 734 | Yes | 25 | 850 | 75 | 80 | 40 | 349 | 400 | 30 | 44 | Yes | Comparative Example |
| 17 | F | 734 | Yes | 15 | 800 | 240 | 90 | 100 | 246 | 400 | 90 | 44 | Yes | Example |
| 18 | F | 734 | Yes | 15 | 820 | 240 | 90 | 100 | 246 | 400 | 0 | 44 | Yes | Comparative Example |
| 19 | F | 734 | Yes | 15 | 800 | 240 | 90 | 100 | 246 | 450 | 900 | 16 | Yes | Comparative Example |
| 20 | G | 736 | Yes | 20 | 850 | 60 | 100 | 200 | 351 | 500 | 30 | 7 | Yes | Example |
| 20-1 | G | 736 | No | 20 | 850 | 60 | 30 | 180 | 322 | 500 | 30 | 7 | Yes | Example |
| 21 | H | 695 | Yes | 20 | 840 | 120 | 90 | 140 | 287 | 400 | 30 | 44 | Yes | Example |
| 22 | I | 713 | Yes | 20 | 830 | 75 | 150 | 220 | 360 | 500 | 45 | 7 | Yes | Example |
| 23 | J | 718 | Yes | 15 | 800 | 45 | 80 | 180 | 316 | 400 | 20 | 44 | No | Example |
| 24 | K | 716 | Yes | 15 | 750 | 200 | 100 | 210 | 367 | 550 | 10 | 3 | Yes | Example |
| 25 | L | 708 | Yes | 15 | 780 | 120 | 150 | 220 | 406 | 400 | 60 | 44 | Yes | Example |
| 26 | M | 706 | Yes | 25 | 840 | 90 | 150 | 160 | 348 | 400 | 20 | 44 | No | Example |
| 27 | N | 733 | Yes | 25 | 820 | 60 | 50 | 210 | 354 | 450 | 90 | 16 | Yes | Example |
| 28 | O | 728 | Yes | 20 | 800 | 60 | 30 | 180 | 340 | 400 | 60 | 44 | Yes | Comparative Example |
| 29 | P | 679 | Yes | 20 | 820 | 90 | 80 | 200 | 317 | 400 | 30 | 44 | Yes | Comparative Example |
| 30 | Q | 741 | Yes | 15 | 820 | 75 | 80 | 190 | 323 | 400 | 120 | 44 | Yes | Comparative Example |

*) Time calculated by the following equation $t(s) = 2.5 \times 10^{-5}/\mathrm{Exp}(-80400/8.31/(T + 273))$ T: Reheating Temperature (° C.)

The galvanized steel sheets thus produced were examined for cross-sectional microstructure, tensile properties, stretch flangeability, and deep drawability. Table 3 shows the results.

A cross-sectional microstructure of a steel sheet was exposed using a 3% nital solution (3% nitric acid+ethanol), and observed with a scanning electron microscope at a quarter thickness in the depth direction. A photograph of microstructure thus taken was subjected to image analysis to determine the area fraction of ferrite phase. (Commercially available image processing software can be used in the image analysis.)

The area fraction of martensite phase and tempered martensite phase were determined from SEM photographs using image processing software. The SEM photographs were taken at an appropriate magnification in the range of 1000 to 3000 in accordance with the fineness of microstructure. The volume fraction of retained austenite phase was determined by polishing a steel sheet to a surface at a quarter thickness and measuring the X-ray diffraction intensity of the surface. Intensity ratios were determined using MoKa as incident X-rays for all combinations of integrated peak intensities of {111}, {200}, {220}, and {311} planes of retained austenite phase and {110}, {200}, and {211} planes of ferrite phase. The volume fraction of retained austenite phase was a mean value of the intensity ratios.

The average grain size of retained austenite phase of steel was a mean value of crystal grain sizes of 10 grains. The crystal grain size was determined by measuring the area of retained austenite in a grain arbitrarily selected with a transmission electron microscope and, on the assumption that the grain is a square, calculating the length of one side of the square as the diameter of the grain.

The average concentration of dissolved C ([Cγ%]) in a retained austenite phase can be calculated by substituting the lattice constant a (angstrom), which is determined from a diffraction plane (220) of fcc iron with an X-ray diffractometer using Co-Kα, [Mn %], and [Al %] into the following formula (2):

$$a=3.578+0.033[C\gamma\%]+0.00095[Mn\ \%]+0.0056[Al\ \%] \quad (2)$$

wherein [Cγ%] denotes the average concentration of dissolved C in retained austenite, and [Mn %] and [Al %] denote the Mn content and the Al content (% by mass), respectively.

As for tensile properties, a tensile test was performed in accordance with JIS Z 2241 using JIS No. 5 test specimens taken such that the tensile direction was perpendicular to the rolling direction of a steel sheet. The yield stress (YS), tensile strength (TS), and elongation (EL) were measured to calculate the yield ratio (YS/TS) and the balance between strength and elongation, which was defined by the product of strength and elongation (TS×EL).

The hole expansion ratio (λ) was determined in a hole expansion test in accordance with the Japan Iron and Steel Federation standard JFST1001.

Deep drawability was evaluated as a limiting drawing ratio (LDR) in a Swift cup test. In the Swift cup test, a cylindrical punch had a diameter of 33 mm, and a metal mold had a punch corner radius of 5 mm and a die corner radius of 5 mm. Samples were circular blanks that were cut from steel sheets. The blank holding pressure was three tons and the forming speed was 1 mm/s. Since the sliding state of a surface varied with the plating state, tests were performed under a high-lubrication condition in which a Teflon sheet was placed between a sample and a die to eliminate the effects of the sliding state of a surface. The blank diameter was altered by a 1 mm pitch. LDR was expressed by the ratio of blank diameter D to punch diameter d (D/d) when a circular blank was deep drawn without breakage.

TABLE 3

| No. | Type of steel | Area fraction of ferrite phase (%) | Area fraction of martensite phase (%) | Area fraction of tempered martensite phase (%) | Volume fraction of retained austenite (%) | Average grain size of retained austenite (μm) | Dissolved C in retained austenite (%) | Other phases*1 | TS (MPa) | EL (%) | TS × EL/ MPa · % | Hole expansion ratio (%) | LDR | |
|---|---|---|---|---|---|---|---|---|---|---|---|---|---|---|
| 1 | A | 75 | 0 | 20 | 5 | 1.5 | 1.07 | — | 635 | 34 | 21590 | 76 | 2.12 | Example |
| 2 | A | 70 | 0 | 23 | 7 | 2.3 | 1.05 | — | 628 | 35 | 21980 | 54 | 2.12 | Comparative Example |
| 3 | A | 76 | 0 | 23 | 1 | 1.2 | 1.08 | — | 637 | 28 | 17836 | 78 | 2.06 | Comparative Example |
| 4 | B | 56 | 0 | 38 | 6 | 1.7 | 1.06 | — | 689 | 32 | 22048 | 82 | 2.12 | Example |
| 5 | B | 67 | 0 | 20 | 0 | — | — | P | 620 | 28 | 17360 | 50 | 2.03 | Comparative Example |
| 6 | B | 48 | 0 | 43 | 9 | 2.7 | 1.08 | — | 680 | 33 | 22440 | 47 | 2.12 | Comparative Example |
| 7 | C | 70 | 0 | 25 | 5 | 1.6 | 1.12 | — | 690 | 31 | 21390 | 75 | 2.15 | Example |
| 8 | C | 76 | 0 | 15 | 0 | — | — | P | 645 | 27 | 17415 | 63 | 2.03 | Comparative Example |
| 9 | C | 70 | 0 | 29 | 1 | 1.6 | 1.14 | — | 674 | 27 | 18198 | 85 | 2.06 | Comparative Example |
| 10 | D | 55 | 0 | 38 | 7 | 1.8 | 1.07 | — | 734 | 31 | 22754 | 87 | 2.09 | Example |
| 11 | D | 68 | 0 | 17 | 1 | 1.5 | 0.85 | P | 688 | 26 | 17888 | 62 | 2.03 | Comparative Example |
| 12 | D | 45 | 14 | 32 | 9 | 1.7 | 1.03 | — | 755 | 31 | 23405 | 40 | 2.09 | Comparative Example |
| 13 | E | 64 | 5 | 25 | 6 | 1.4 | 0.85 | — | 875 | 26 | 22750 | 75 | 2.06 | Example |
| 14 | E | 66 | 11 | 22 | 1 | 1.3 | 0.65 | — | 913 | 19 | 17347 | 53 | 2.03 | Comparative Example |
| 15 | E | 67 | 0 | 21 | 0 | — | — | P | 822 | 21 | 17262 | 76 | 2.03 | Comparative Example |
| 16 | E | 64 | 0 | 35 | 1 | 1.3 | 0.78 | — | 860 | 22 | 18920 | 80 | 2.03 | Comparative Example |
| 17 | F | 60 | 4 | 30 | 6 | 1.6 | 1.18 | — | 1005 | 22 | 22110 | 77 | 2.18 | Example |
| 18 | F | 60 | 9 | 30 | 1 | 1.4 | 0.51 | — | 1040 | 17 | 17680 | 43 | 2.03 | Comparative Example |
| 19 | F | 60 | 0 | 30 | 1 | 1.4 | 0.83 | B | 975 | 19 | 18525 | 85 | 2.06 | Comparative Example |
| 20 | G | 69 | 0 | 25 | 6 | 1.6 | 1.12 | — | 798 | 28 | 22344 | 75 | 2.18 | Example |
| 20-1 | G | 74 | 0 | 21 | 5 | 1.5 | 1.10 | — | 786 | 29 | 22794 | 73 | 2.15 | Example |
| 21 | H | 62 | 6 | 26 | 6 | 1.3 | 0.97 | — | 1060 | 21 | 22260 | 79 | 2.06 | Example |

TABLE 3-continued

| No. | Type of steel | Area fraction of ferrite phase (%) | Area fraction of martensite phase (%) | Area fraction of tempered martensite phase (%) | Volume fraction of retained austenite (%) | Average grain size of retained austenite (μm) | Dissolved C in retained austenite (%) | Other phases*[1] | TS (MPa) | EL (%) | TS × EL/ MPa · % | Hole expansion ratio (%) | LDR | |
|---|---|---|---|---|---|---|---|---|---|---|---|---|---|---|
| 22 | I | 70 | 2 | 22 | 6 | 1.4 | 1.06 | — | 964 | 23 | 22172 | 73 | 2.12 | Example |
| 23 | J | 73 | 0 | 21 | 6 | 1.6 | 0.81 | — | 927 | 24 | 22248 | 75 | 2.06 | Example |
| 24 | K | 54 | 7 | 32 | 7 | 1.4 | 1.14 | — | 997 | 24 | 23928 | 83 | 2.15 | Example |
| 25 | L | 48 | 0 | 45 | 7 | 1.4 | 1.04 | — | 648 | 35 | 22680 | 85 | 2.12 | Example |
| 26 | M | 35 | 8 | 50 | 7 | 1.7 | 0.92 | — | 1078 | 22 | 23716 | 83 | 2.06 | Example |
| 27 | N | 72 | 0 | 22 | 6 | 1.5 | 1.05 | — | 959 | 24 | 23016 | 75 | 2.12 | Example |
| 28 | O | 90 | 0 | 8 | 2 | 1.3 | 1.03 | — | 486 | 34 | 16524 | 84 | 2.03 | Comparative Example |
| 29 | P | 31 | 15 | 50 | 4 | 1.8 | 0.65 | — | 1288 | 12 | 15456 | 48 | 2.03 | Comparative Example |
| 30 | Q | 85 | 0 | 5 | 0 | 1.4 | — | P | 535 | 30 | 16050 | 73 | 2.03 | Comparative Example |

*[1]P denotes perlite and B denotes bainite

Table 3 shows that steel sheets according to working examples had balances between TS and EL (TS×EL) of 21000 MPa·% or more and λ of 70% or more, indicating excellent strength, ductility, and stretch flangeability. Steels that contained at least 1% of dissolved C on average in a retained austenite phase had LDR of 2.09 or more and had excellent deep drawability.

Steel sheets according to comparative examples had balances between TS and EL (TS×EL) of less than 21000 MPa·% and/or λ of less than 70%. Thus, at least one of strength, ductility, and stretch flangeability was poor.

What is claimed is:

1. A method of manufacturing a high-strength galvanized steel sheet comprising:

hot-rolling a slab comprising on the basis of mass percent, C: 0.05% to 0.3%, Si: 0.01% to 2.5%, Mn: 0.5% to 3.5%, P: 0.003% to 0.100% or less, S: 0.02% or less, and Al: 0.010% to 1.5%, the total of Si and Al being 0.5% to 2.5%, the remainder being iron and incidental impurities, to form a steel sheet;

during continuous annealing, heating the steel sheet to a temperature of 750° C. to 900° C. at an average heating rate of at least 10° C./s at a temperature of 500° C. to an $A_1$ transformation point;

holding that temperature for at least 10 seconds;

cooling the steel sheet from 750° C. to a temperature of (Ms point—100° C.) to (Ms point—200° C.) at an average cooling rate of at least 10° C./s;

reheating the steel sheet to a temperature of 350° C. to 600° C.;

holding that temperature for 10 to 600 seconds to form a microstructure in the steel sheet that includes 20% or more of ferrite phase, 10% or less of martensite phase, and 10% to 60% of tempered martensite phase, on the basis of area percent, and 3% to 10% of retained austenite phase on the basis of volume percent, and the retained austenite phase has an average grain size of 2.0 μm or less; and galvanizing the steel sheet.

2. A method of manufacturing a high-strength galvanized steel sheet comprising:

hot-rolling and cold-rolling a slab comprising on the basis of mass percent, C: 0.05% to 0.3%, Si: 0.01% to 2.5%, Mn: 0.5% to 3.5%, P: 0.003% to 0.100% or less, S: 0.02% or less, and Al: 0.010% to 1.5%, the total of Si and Al being 0.5% to 2.5%, the remainder being iron and incidental impurities, to form a steel sheet;

during continuous annealing, heating the steel sheet to a temperature of 750° C. to 900° C. at an average heating rate of at least 10° C./s at a temperature of 500° C. to an $A_1$ transformation point;

holding that temperature for at least 10 seconds;

cooling the steel sheet from 750° C. to a temperature of (Ms point—100° C.) to (Ms point—200° C.) at an average cooling rate of at least 10° C./s:

reheating the steel sheet to a temperature of 350° C. to 600° C.;

holding that temperature for 10 to 600 seconds to form a microstructure that includes 20% or more of ferrite phase, 10% or less of martensite phase, and 10% to 60% of tempered martensite phase, on the basis of area percent, and 3% to 10% of retained austenite phase on the basis of volume percent, and the retained austenite phase has an average grain size of 2.0 μm or less; and galvanizing the steel sheet.

3. The method according to claim 1, wherein the holding time after reheating to 350° C. to 600° C. ranges from t to 600 seconds as determined by the following formula (1):

$$t(s)=2.5\times10^{-5}/\mathrm{Exp}(-80400/8.31/(T+273)) \quad (1)$$

wherein T denotes the reheating temperature (° C.).

4. The method according to claim 1, wherein the galvanizing is followed by alloying.

5. The method according to claim 2, wherein the holding time after reheating to 350° C. to 600° C. ranges from t to 600 seconds as determined by the following formula (1):

$$t(s)=2.5\times10^{-5}/\mathrm{Exp}(-80400/8.31/(T+273)) \quad (1)$$

wherein T denotes the reheating temperature (° C.).

6. The method according to claim 2, wherein the galvanizing is followed by alloying.

* * * * *